US008240237B2

(12) United States Patent
Frolov

(10) Patent No.: US 8,240,237 B2
(45) Date of Patent: Aug. 14, 2012

(54) GUIDE FENCE ASSEMBLY WITH ONE OR MORE MAGNETIC ELEMENTS

(75) Inventor: Andrew Frolov, Glenview, IL (US)

(73) Assignee: Robert Bosch GmbH, Stuttgart (DE)

( * ) Notice: Subject to any disclaimer, the term of this patent is extended or adjusted under 35 U.S.C. 154(b) by 493 days.

(21) Appl. No.: 12/506,970

(22) Filed: Jul. 21, 2009

(65) Prior Publication Data

US 2011/0017040 A1 Jan. 27, 2011

(51) Int. Cl.
*B26D 7/01* (2006.01)

(52) U.S. Cl. ..... 83/446; 83/477.2; 83/468.7

(58) Field of Classification Search ..... 83/466, 83/477.2, 468.7, 102.1, 781, 438, 468.1, 83/468, 441, 440, 477, 477.1, 440.2, 478
See application file for complete search history.

(56) References Cited

U.S. PATENT DOCUMENTS

| | | | | |
|---|---|---|---|---|
| 2,771,920 | A | 11/1956 | Ambelang | |
| 2,786,497 | A | 3/1957 | Brucker | |
| 3,011,531 | A | 12/1961 | Gaskell | |
| 3,082,799 | A | 3/1963 | Kennedy | |
| 4,549,455 | A | 10/1985 | Perilloux, Jr. | |
| 4,934,423 | A | 6/1990 | Withrow | |
| 5,778,953 | A | 7/1998 | Braddock | |
| 5,857,507 | A | 1/1999 | Puzio et al. | |
| 5,965,949 | A | 10/1999 | Fukuda et al. | |
| 6,360,641 | B1 | 3/2002 | Talesky et al. | |
| 6,360,797 | B1 | 3/2002 | Brazell et al. | |
| 6,460,442 | B2 | 10/2002 | Talesky et al. | |
| 6,557,601 | B1 | 5/2003 | Taylor | |
| 6,640,683 | B2 | 11/2003 | Lee | |
| 6,708,412 | B2 * | 3/2004 | Saunders et al. | 30/481 |
| RE38,612 | E | 10/2004 | Tucker et al. | |
| 7,174,820 | B2 | 2/2007 | Huang | |
| 2008/0271583 | A1 | 11/2008 | Chuang | |
| 2009/0084238 | A1 * | 4/2009 | Chang | 83/441.1 |
| 2011/0296968 | A1 * | 12/2011 | Doumani | 83/468.2 |

* cited by examiner

*Primary Examiner* — Ghassem Alie
(74) *Attorney, Agent, or Firm* — Greer, Burns & Crain, Ltd.

(57) ABSTRACT

A guide fence assembly for use with a work table of a table-based device, where the assembly includes an elongated fence body that extends in a longitudinal direction between front and rear ends thereof, and a front glide member that is attached to the elongated fence body. The front glide member is configured and arranged to glide along a front rail of the table-based device. Preferably, there is at least one magnetic element attached to the elongated fence body at a position between the front glide member and the front end of the elongated fence body. The at least one magnetic element is configured and arranged to apply a magnetic attraction force directed in the longitudinal direction toward the rear end of the elongated fence body. Preferably, there is also a locking mechanism for locking the guide fence assembly into a locked position with respect to the work table.

20 Claims, 4 Drawing Sheets

GUIDE FENCE ASSEMBLY WITH ONE OR MORE MAGNETIC ELEMENTS

The present invention relates generally to a guide fence assembly for use with a table-based cutting device, such a rip fence for use with a table saw. More particularly, the invention relates to embodiments of a fence assembly, and/or a device utilizing such an assembly, where the fence assembly includes one or more magnetic elements for temporarily maintaining the position of the fence prior to securely locking the fence assembly into position.

For example, there are instances where, after the user positions the fence assembly in the desired location, the fence moves slightly either prior to or during the locking procedure. Accordingly, in these instances, the fence may not be accurately locked at the desired position.

In order to remedy this situation, the present guide fence assembly includes a magnetic assembly with at least one magnetic element and an associated ferro-magnetic member that cooperate with each other to create a magnetic force that pushes the fence body inwardly, thereby preventing, or at least minimizing, any movement of the guide fence assembly prior to placing it in the final locked position. In addition, the present magnetic assembly also provides for a smoother sliding operation of the fence with respect to the associated rail (or rails) by eliminating, or at least reducing, chatter between the components.

More specifically, the present invention may consist of a guide fence assembly for use with a work table of a table-based device, such as a cutting device. Embodiments of the present guide fence assembly can include an elongated fence body that extends in a longitudinal direction between a front end and a rear end and a front glide member that is attached to the elongated fence body at a position inward of the front end of the elongated fence body. Preferably, the front glide member is configured and arranged to glide along a front rail of the table-based cutting device. Embodiments of the guide fence assembly also include at least one magnetic element that is attached to the elongated fence body at a position between the front glide member and the front end of the elongated fence body. The magnetic element (or elements) is (are) configured and arranged to apply a magnetic attraction force directed in the longitudinal direction toward the rear end of the elongated fence body. Embodiments of the invention also preferably include a locking mechanism for locking the guide fence assembly into a locked position with respect to the work table.

Embodiments of the invention also include a table based device, such as a table saw, that includes a base assembly configured to house a motor for rotating a blade, a table top assembly attached to the base assembly, and an elongated front rail that extending along a front of the table top assembly, where the elongated front rail provides a mounting structure for a guide fence assembly.

BRIEF DESCRIPTION OF THE SEVERAL VIEWS OF THE DRAWINGS

Preferred embodiments of the present invention are described herein with reference to the drawings wherein.

DETAILED DESCRIPTION OF THE INVENTION

Figure 1:
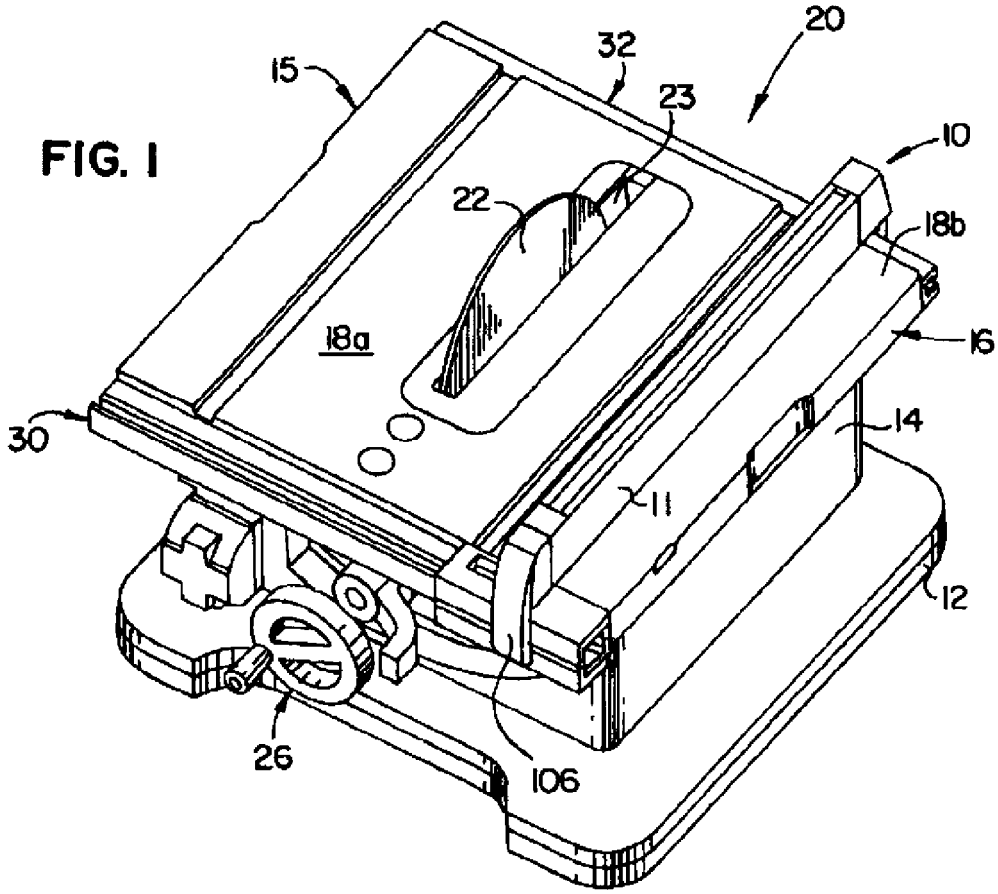
FIG. 1 is a perspective view of one embodiment of a fence assembly shown installed on a power table saw.

Embodiments of the present invention are shown in the drawings, with a first preferred embodiment being shown in FIGS. 1-4, wherein a guide fence assembly, indicated generally at 10, is illustrated in association with an example of a power table saw assembly 20. Since the example of the guide fence assembly 10 shown is part of a table saw, it may be more specifically referred to as a rip fence. The example table saw assembly 20 is similar to that disclosed in U.S. patent application Ser. No. 12/431,044, filed on Apr. 28, 2009, which is assigned to the same assignee as the present invention, and which is hereby incorporated by reference in its entirety.

Although the examples discussed herein show and describe the present guide fence assembly as part of one type of table saw, it should be noted that the present guide fence assembly may be used in other types of table saws, as well as in other types of table-based devices requiring an elongated guide member (both powered and non-powered), and especially in other table-based power cutting devices.

The table saw assembly 20 preferably has a base 12, a frame structure 14, and a top indicated generally at 15, which, in this example, includes a top extension indicated generally at 16 that is slidable relative to the top 15. The top 15 and top extension 16 have top surfaces 18*a* and 18*b*, respectively. The saw assembly also includes a blade 22 that extends through an opening 23 in the top surface 18*a*, and wherein the blade is attached to a motor (not shown) that rotates the blade. As known in the art, the motor is housed within a base assembly that includes the base 12 and the frame structure 14. The saw assembly 20 of this example is a portable table saw that has a bevel and blade height adjust mechanism, indicated generally at 26.

As can be seen in FIG. 1, the guide fence assembly 10 is attached to an elongated front rail, indicated generally at 30. Additionally, in this embodiment, the fence assembly 10 is also attached to an elongated rear rail, indicated generally at 32. Although such secondary attachment of the guide fence assembly to a rear rail is necessary in most applications, it is contemplated that attachment to only a front rail may be sufficient in certain applications.

The rails 30 and 32 are preferably metal extrusions that are configured to interact with locking mechanisms of the fence 20. Optionally, the rails 30, 32 may be configured so that they can be locked in both an upright operating position as well as in an upside down storage position, with respect to the same rails, such as in the embodiments shown in the figures. Such rails can be symmetric about a horizontal line, resulting in upper and lower are portions that are the mirror image of each other. However, if the upside down storage position of the fence is not desired, the rails could be configured without the lower mirror-image portions. The rails may be made of aluminum, which is strong and lightweight and which lessens the weight of the saw and still enables the fence 20 to be locked in either its operating or stored positions. Alternately, the front rail 30, or both rails 30 and 32, may be partially or entirely made of a ferro-magnetic material, such as steel or iron, so that the front rail magnetically interacts with a magnetic element, as described more fully below.

As shown in FIG. 1, the rails 30 and 32 preferably extend along the front and rear vertical surfaces of the table top 15 and top extension 16 to thereby enable the guide fence 10 to be removed and placed on either side of the blade 22. Optionally, the rails 30 and 32 may be mounted in a manner whereby they are securely attached to the top extension 16 so that the rails, as well as the top extension, are slidable relative to the tabletop 15 so that when the extension 16 is moved to its extended or separated position, the range of the fence is extended well beyond the right edge of the table top 15.

Turning now to the FIG. 2, one preferred embodiment of the guide fence assembly 10, will be described. Many aspects of fence assembly 10, with the exception of certain components, such as the glide member and the magnetic element and associated components described below, are similar to that shown in U.S. Pat. No. 6,360,641, which is assigned to the same assignee as the present invention, and which is hereby incorporated by reference in its entirety.

The fence 10, which can be considered to include an elongated fence body 11 that extends in the longitudinal direction between a front end and a rear end, has a locking mechanism that includes, in this embodiment, a front clamping mechanism, indicated generally at 100, and a rear clamping mechanism, indicated generally at 102, which engage the front and rear ends of the fence 10 to the front and rear rails 30 and 32. The front and rear clamping mechanisms 100 and 102 interact with one another by virtue of a rod 104 that extends between them. Moreover, the rod 104 is configured and arranged to transfer motion from a handle 106 to the second clamping mechanism 102. The handle 106 is configured to change the locking mechanism between a locked position and a released position, as discussed in detail below.

More specifically, the handle 106 of this example is rotatable about a pivot 108 that is anchored in a front casting 109. The handle is in turn connected to a link 110 which is connected to a cam member 112. A front glide member 114 is also attached to the casting 109 by screws (not shown) or other known attachment means, such as adhesive. The glide member 114 extends downwardly and is configured and arranged to glide along the front rail 30 by engaging the recess 36 of the front rail 30 when the fence is placed on the rail 30, as shown. The cam 112 engages an activation plate 116 that pivots around pivot point 118, the upper end of which engages the rod 104.

Figure 2:
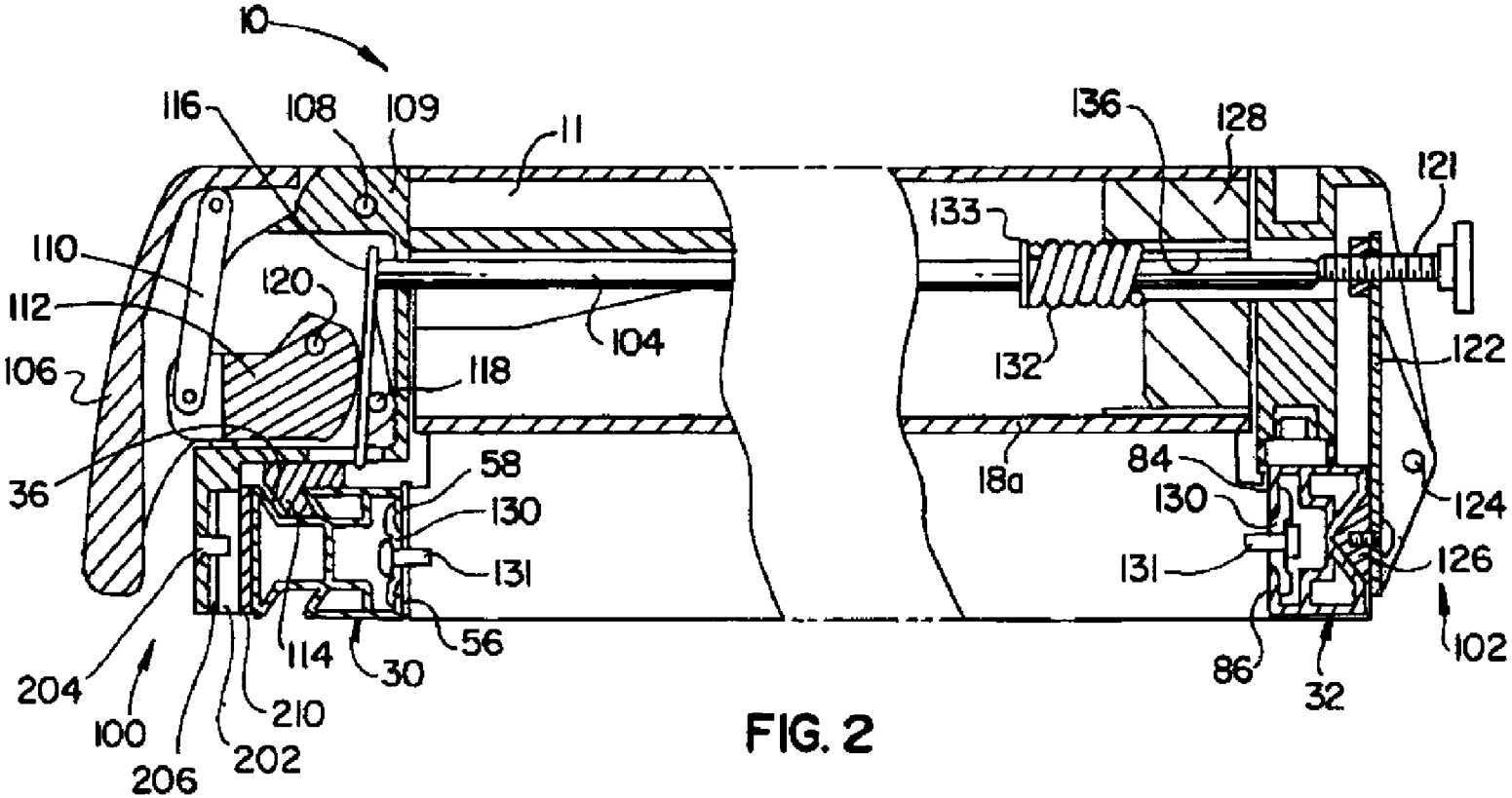
FIG. 2 is a side view, partially in section and with portions removed, illustrating the FIG. 1 embodiment of the fence assembly installed and locked on the power table saw.

When the handle 106 is in the position shown in FIG. 2, the guide fence assembly 10 is locked with respect to both the front end and the back end, and securely holds the fence to both of the rails. When the handle 106 is rotated upwardly, i.e., clockwise about the pivot 108, the cam will be rotated in a clockwise manner around its pivot 120 which results in the front clamping mechanism 100 being released. This enables the handle end portion of the fence to be lifted and the locking tab 114 to be drawn out of the recess 36 of the front rail 30.

With regard to the rear clamping mechanism 102, an adjustment screw 121 is screwed into a threaded hole in the upper end of a rear activating plate 122, and contacts the left end portion of the rod 104. The rear activating plate 122 is rotatable around pivot 124 and has a triangular tab 126 at its lower portion which engages the recess 70 of the rear rail 32. Thus, when the handle 106 is in its locked or clamping position, the triangular tab 126 fully engages the rear rail 32 and the locking tab 114 engages the recess 36 in the front rail 30.

The guide fence 10 of this embodiment also has a block 128 with an aperture 136 through which the left end of the rod 104 passes to contact the screw 121. A spring 132 has one end that bears against the block 128 and its opposite end bears against an annular washer 133 that is attached to the rod so that the spring biases the rod toward the right and moves the rod in that direction when the handle 106 is lifted to disengage the locking mechanism. Another spring (not shown) may be provided to rotate the activating plate 122 in the clockwise direction to disengage the locking mechanism 102 when the handle 106 is lifted to the unlocked or released position.

One important aspect of the present guide fence assembly is the inclusion of a means for securely maintaining the fence assembly in a selected position immediately prior to activating the locking mechanism. For example, there are instances where, after the user positions the fence assembly in the desired location, the fence moves slightly either prior to or during the locking procedure. Accordingly, in these instances, the fence may not be accurately locked at the desired position.

In order to remedy this situation, the present guide fence assembly includes a magnetic assembly with at least one magnetic element and an associated ferro-magnetic member that cooperate with each other to create a magnetic force that pushes the fence body inwardly, thereby preventing, or at least minimizing, any movement of the guide fence assembly prior to placing it in the locked position. In addition, the present magnetic assembly also provides for a smoother sliding operation of the fence with respect to the rail (or rails) by eliminating, or at least reducing, chatter between the components.

More specifically, one embodiment of such a magnetic assembly will be described while referring to FIGS. 2 and 3. This example of a configuration of the elongated front rail 30, which is best shown in the enlarged drawing of FIG. 3, has a top wall 34 in which a recess 36 is located, with the recess being defined by an angled front wall 38, a bottom wall 40, and a rear wall 42. The front and rear walls 38 and 42 are preferably inclined at an angle that is preferably the same and is approximately 40° relative to vertical, but can be any acute angle compatible with receiving and retaining the locking mechanism of the fence 10.

Optionally, the front rail 30 may also include the same profile on its bottom portion, which allows for the fence assembly to be stored in an upside-down state, as mentioned above. Such a configuration preferably includes a bottom wall 44 that has a similar recess 46 with front, bottom and rear walls 48, 50 and 52 that are symmetrical with the recess 36 and the walls 38, 40 and 42 in the top surface 34. The rear walls 42 and 52 merge with a connecting wall 54. The top and bottom walls 44 and 34 have respective inwardly extending wall portions 56 and 58, respectively, which define a mounting portion with a large mounting recess 60. An interior structural wall 62 merges with right angled wall portions 64 and 66 that extend to the respective top and bottom walls 34 and 44.

Attached to the front casting 109 is a magnetic assembly that includes at least one magnetic element 202, which preferably consists of one or more permanent magnets. The magnetic element(s) 202 may be affixed to the front casting 109 in any know manner, such as with one or more screws 204, an adhesive, a press fit, etc. Optionally, there may be a removable shim 206 seated behind magnetic element 202 for adjusting the location of the magnetic element. Removable shims of different thicknesses may be utilized as a means for adjusting the longitudinal position of the magnetic element 202 with respect to the fence body. In the alternative, it is also contemplated that an adjusting screw (not shown) or other structure may also be utilized as the means for adjusting. For example, one or more adjusting screws could be used to push the magnetic element toward the rail (similar to the shim previously described), and one or more mounting screws could be used to fix the magnetic element into the desired position with respect to the rail.

The magnetic assembly of this embodiment also includes a ferro-magnetic member 210 made of a ferro-magnetic material such as iron or steel, which material is preferably protected from rust by being galvanized or covered with a protective coating. The ferromagnetic member 210 may consist of a metal strip attached to the elongated front rail 30 in any known manner, such as by using an adhesive, screws, rivets, etc. or the ferromagnetic member may be secured to the rail by being pressed into notches 43 in the rail as shown in FIG. 3A. Alternatively, the entire elongated front rail 30, or at least connecting wall 54, may be made of a ferro-magnetic material, whereby the separate member 210 may be eliminated. The two main components of the magnetic assembly (the ferro-magnetic member 210 and the magnetic element(s) 202) may be separated from each other by a slight gap or space, as shown in FIG. 3, or may make sliding contact with each other, as shown in FIG. 2.

Figure 3:
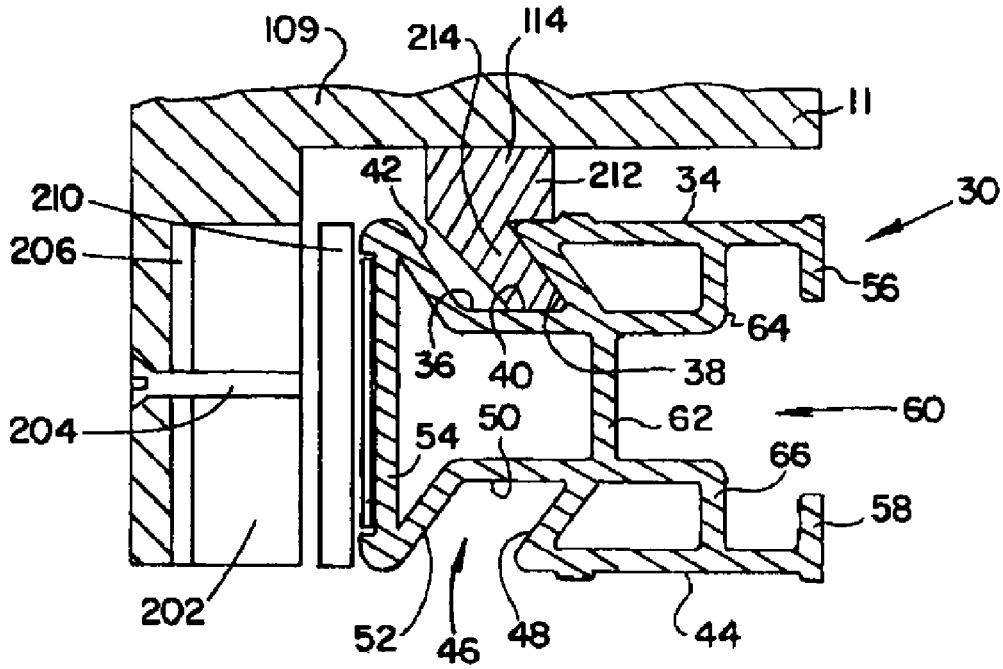
FIG. 3 is an enlarged sectional view of a portion of some of the main components of the fence assembly and front rail of FIG. 2.
Figure 3A:
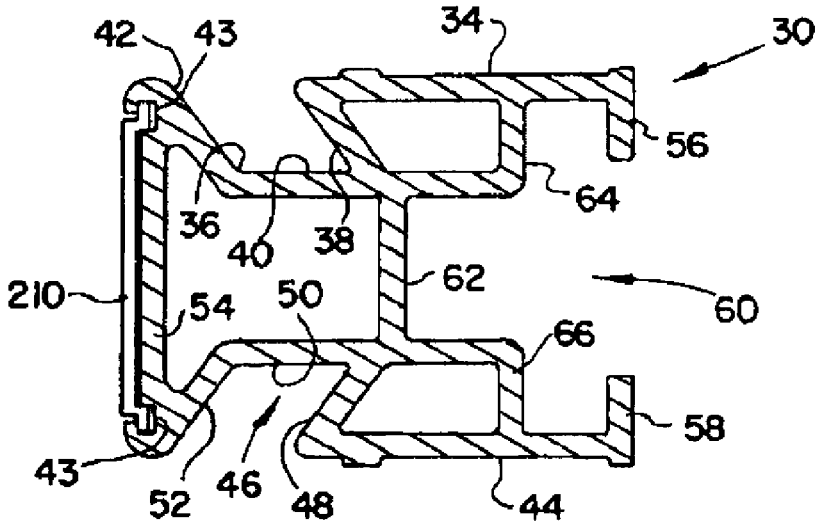
FIG. 3A is a view similar to FIG. 3, except of an embodiment in which the ferro-magnetic member is pressed into notches in the rail.

As best shown in FIG. 3, the front glide member 114 of this embodiment is preferably of a generally L-shaped configuration defined by a generally horizontal leg 212 and a generally vertical leg 214. The interior angle defined between the horizontal and vertical legs 212 and 214 is preferably less than 90°, and preferably is also equal, or approximately equal, to the angle defined between the front and rear walls 38 and 42 of the elongated front rail 30, which, as mentioned above, may be approximately 40°. However, any other appropriate acute angle may also be utilized.

In this embodiment, the bottom wall 40 of the elongated front rail 30 acts as a generally horizontally extending bearing surface for making sliding contact with the generally horizontal leg 212, and the front wall 38 acts as a generally vertically extending bearing surface for making sliding contact with the generally vertical leg 214. Of course, in the embodiment shown, front wall 38 is not perfectly vertical with respect to top wall 34, but is instead somewhat inclined.

As can be seen from a review of FIGS. 2 and 3, the magnetic element 202 creates a magnetic attraction force toward the ferro-magnetic material 210, thereby moving the fence assembly 20 in the longitudinal direction towards the rear clamping mechanism 102. With this magnetic attraction force, the generally vertical leg 214 of the glide member 114 is pushed into contact with front wall 38 of the elongated front rail 30. In other words, the magnetic attraction force positions the fence assembly 10 in essentially the same longitudinal place as the locked position, except with only enough force to impede transverse movement, but not enough to prevent transverse movement (as the locking mechanism does). Thus, as movement of the guide fence assembly 10 in the transverse direction is impeded by the magnetic assembly, the desired position of the fence assembly is more accurately maintained when locking it into position via the locking mechanism (i.e., by rotating the handle 106 to activate the front and rear clamping mechanisms 100 and 102).

Additionally, the magnetic attraction force of the magnetic assembly also helps to eliminate, or at least minimize, chatter generated by choppy movement between the glide member 114 and the front rail 30. This is the case because the magnetic assembly inhibits such choppy movement by maintaining the vertical leg 214 of the glide member 114 in sliding contact with the front wall 38 of the recess 36 of the elongated front rail 30. Thereby, the magnetic assembly provides for smoother transverse movement of the guide fence assembly 10 along the front and rear rails 30 and 32.

Figure 4:
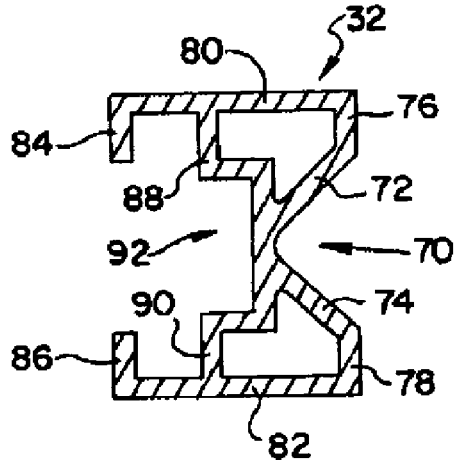
FIG. 4 is an enlarged sectional view of the rear rail of FIG. 2.

Some details of an example of the rear rail 32 will be explained next, with reference to FIGS. 2 and 4. In this embodiment, the rear rail 32 has a generally V-shaped recess 70 defined by walls 72 and 74, which merge with outer end wall portions 76 and 78 that in turn merge with a top wall 80 and a bottom wall 82. These two walls also have inwardly directed front wall portions 84 and 86 which, together with angled central wall portions 88 and 90, form a mounting portion recess 92 that is very similar to the configuration of the mounting portion of the front rail 30.

As previously mentioned, the rails 30 and 32 may be mounted in a manner whereby they and extension 16 can slide relative to the front and rear surfaces of the table top 15 and in this regard, and referring to FIG. 2, one example of such a mounting configuration is shown to include a mounting plate 130 that has a base portion having a width that is slightly less than the distance between the inside surfaces of the top and bottom walls 34 and 44 for the front rail 30 and the inside surfaces of the top and bottom walls 80 and 82 of the rear rail 32. The base portion of the mounting plate 130 abuts the front or rear vertical surfaces of the table top 15 and the extension 16. The mounting plate 130 has wider top and bottom portions that engage the inside surfaces of the wall portions 56 and 58 of the front rail 30 and wall portions 85 and 86 of the rear rail 32. At least two screws 131 are used to attach each mounting plate 130 to each of the front and rear walls of the table top extension 16 so as to securely attach the rails to the extension 16. It should be understood that other mounting mechanisms can be used to accomplish such desirable sliding without introducing unwanted movement that could interfere with the accuracy and effectiveness of the use of the fence on the device.

Figure 5:
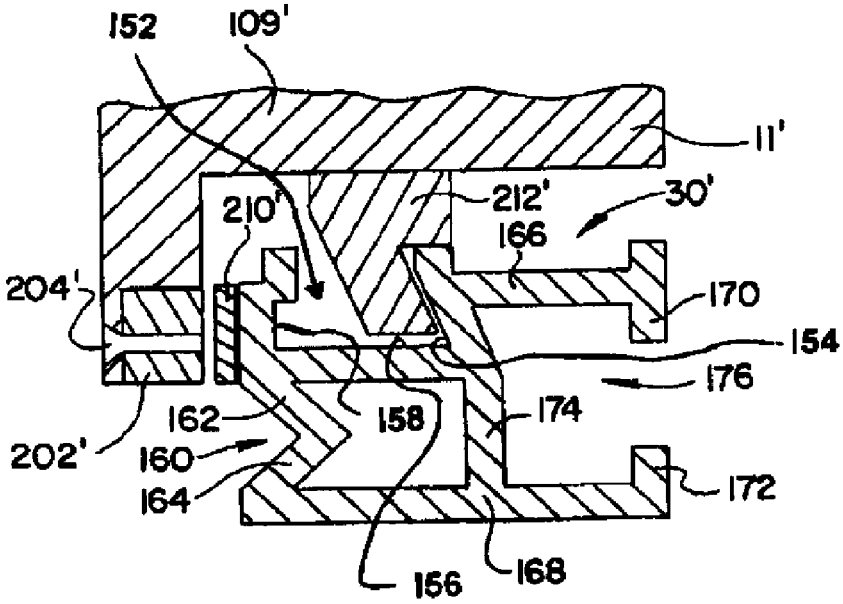
FIG. 5 is a view similar to that of FIG. 3, except of a different embodiment of the fence assembly and associated front rail.

An alternative embodiment of the front rail is shown in FIG. 5 where a front rail is indicated generally at 30'. The front rail of this embodiment has an upper recess 152 that is formed by a front wall 154, bottom wall 156 and a rear wall 158 which is also the outer end wall of the extrusion. The front wall includes a V-shaped recess 160 which is formed by angled walls 162 and 164. The opposite end portion has a top wall portion 166 and a bottom wall portion 168, with inwardly directed end portions 170 and 172 which together with a structural wall 174 define a mounting recess 176 that is similar to the mounting portion 60 and 92 of the front and rear rails 30 and 32, respectively. An advantage of this embodiment of a rail is that it can be simply turned upside down and be mounted to the rear edge of the table, thereby enabling a single extrusion to be used for both the front and rear rails. While the fence 10 may require some modification, it should be understood that if the fence 10 were to be modified to operate with the alternative embodiment in the upright position, it could be turned upside down, have its ends reversed (whereby the handle portion would be placed on the rear end of the saw) and be attached in its upside down position.

The magnetic assembly of the alternative embodiment of FIG. 5 includes essentially the same components, which function in essentially the same way, as the magnetic assembly of the embodiment of FIGS. 1-4. More specifically, the FIG. 5 embodiment includes a front casting 109', at least one magnetic element 202', a screw 204' (or other attachment means), a ferro-magnetic member 210', an elongated fence body 5', and a glide member with a horizontal leg 212'. Although not shown in FIG. 5, this embodiment may also include a shim or other means for adjusting the longitudinal position of magnetic element 202'.

The example embodiments shown and described above each include one or more magnetic elements on the guide fence assembly and a ferro-magnetic material associated with a rail upon which the fence assembly is mounted. However, it is also contemplated that the components could be reversed, such that the ferro-magnetic material is associated with the guide fence assembly and the magnetic element (or elements) are attached to the rail. It is also contemplated that instead of the permanent magnets (or magnets) described above, one or more electromagnets could also be employed.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A guide fence assembly for use with a work table of a table-based device, said guide fence assembly comprising:

an elongated fence body extending in a longitudinal direction between a front end and a rear end;

a front glide member attached to said elongated fence body at a position inward of said front end of said elongated fence body, said front glide member being configured and arranged to glide along a front rail of the table-based device;

at least one magnetic element attached to said elongated fence body at a position between said front glide member and said front end of said elongated fence body, said at least one magnetic element being configured and arranged to apply a magnetic attraction force directed in the longitudinal direction toward said rear end of said elongated fence body; and a locking mechanism for locking said guide fence assembly into a locked position with respect to the work table.

2. The guide fence assembly as defined in claim 1, wherein said locking mechanism comprises:

a front clamping mechanism associated with said front end of said elongated fence body; and a second clamping mechanism associated with said elongated fence body at a position other than said front end.

3. The guide fence assembly as defined in claim 2, wherein said second clamping mechanism is associated with said rear end of said elongated fence body.

4. The guide fence assembly as defined in claim 3, wherein said locking mechanism further comprises:

a handle for changing said locking mechanism between the locked position and a released position, said handle being positioned on said front end of said elongated fence body; and a rod extending between said front clamping mechanism and said second clamping mechanism, said rod being configured and arranged to transfer motion from said handle to said second clamping mechanism.

5. The guide fence assembly as defined in claim 1, further comprising means for adjusting a longitudinal position of said at least one magnetic element with respect to said elongated fence body.

6. The guide fence assembly as defined in claim 5, wherein said means for adjusting comprises a removable shim seated between said at least one magnetic element and said front end of said elongated fence body.

7. The guide fence assembly as defined in claim 5, wherein said means for adjusting comprises a threaded member seated within a threaded aperture formed within said elongated fence body.

8. The guide fence assembly according to claim 1, wherein said front glide member is of an L-shaped configuration.

9. The guide fence assembly according to claim 1, wherein said at least one magnetic element comprises at least one permanent magnet.

10. A table saw comprising:

a base assembly;

a table top assembly attached to said base assembly, said table top assembly including a top surface with an opening therein through which a blade extends; and an elongated front rail extending along a front of said table top assembly, said elongated front rail providing a mounting structure for a guide fence assembly;

wherein said elongated front rail includes a ferro-magnetic material on a front facing surface thereof, and wherein said guide fence assembly includes:

an elongated fence body extending in a longitudinal direction between a front end and a rear end;

a front glide member attached to said elongated fence body at a position inward of said front end of said elongated fence body, said front glide member being configured and arranged to glide along said elongated front rail;

at least one magnetic element attached to said elongated fence body at a position facing said ferro-magnetic material, said at least one magnetic element being configured and arranged to apply a magnetic attraction force directed towards said ferro-magnetic material; and a locking mechanism for locking said guide fence assembly into a locked position with respect to said table top assembly.

11. The table saw according to claim 10, wherein:

said front glide member is of an L-shaped configuration defined by a generally horizontal leg and a generally vertical leg;

said elongated front rail includes a generally horizontally extending bearing surface for making sliding contact with said generally horizontal leg, and a generally vertically extending bearing surface for making sliding contact with said generally vertical leg.

12. The table saw according to claim 11, wherein an interior angle defined between said generally horizontal leg and said generally vertical leg is less than 90°.

13. The table saw according to claim 10, wherein a space is defined between said at least one magnetic element and said ferromagnetic material.

14. The table saw according to claim 10, wherein said at least one magnetic element makes sliding contact with said ferromagnetic material.

15. The table saw according to claim 10, wherein said ferro-magnetic material comprises a metal strip attached to said elongated front rail.

16. The table saw according to claim 10, wherein said ferromagnetic material comprises said elongated front rail being formed of a ferro-magnetic metal.

17. The table saw according to claim 10, wherein said at least one magnetic element comprises at least one permanent magnet.

18. A table saw comprising:

a base assembly;

a table top assembly attached to said base assembly, said table top assembly including a top surface with an opening therein through which a blade extends; and an elongated front rail extending along a front of said table top assembly, said elongated front rail providing a mounting structure for a guide fence assembly;

wherein said elongated front rail includes at least one magnetic element on a front facing surface thereof, and wherein said guide fence assembly includes:

an elongated fence body extending in a longitudinal direction between a front end and a rear end;

a front glide member attached to said elongated fence body at a position inward of said front end of said elongated fence body, said front glide member being configured and arranged to glide along said elongated front rail;

said elongated fence body including a ferro-magnetic material located at a position facing said at least one magnetic element, such that said at least one magnetic element is configured and arranged to apply a magnetic attraction force directed towards said ferro-magnetic material; and a locking mechanism for locking said guide fence assembly into a locked position with respect to said table top assembly.

19. The table saw according to claim 18, wherein:

said front glide member is of an L-shaped configuration defined by a generally horizontal leg and a generally vertical leg; and said elongated front rail includes a generally horizontally extending bearing surface for making sliding contact with said generally horizontal leg, and a generally vertically extending bearing surface for making sliding contact with said generally vertical leg.

20. The table saw according to claim 18, wherein said ferro-magnetic material comprises a metal strip attached to said elongated front rail, and further wherein said at least one magnetic element comprises at least one permanent magnet.

* * * * *